United States Patent [19]

Hegg

[11] Patent Number: 4,639,658

[45] Date of Patent: Jan. 27, 1987

[54] FLOAT STABILIZED CONSTANT CURRENT SOURCE

[75] Inventor: Jeffrey W. Hegg, Clearwater, Fla.

[73] Assignee: Honeywell Inc., Minneapolis, Minn.

[21] Appl. No.: 854,960

[22] Filed: Apr. 23, 1986

[51] Int. Cl.[4] ..... G05F 1/00

[52] U.S. Cl. ..... 323/204; 318/432

[58] Field of Search ..... 74/5.6 D, 5.6 E; 323/204; 318/432, 580, 689

[56] References Cited

U.S. PATENT DOCUMENTS 4,487,083 12/1984 Quermann ..... 74/5.6 E

*Primary Examiner*—Peter S. Wong
*Assistant Examiner*—Judson H. Jones
*Attorney, Agent, or Firm*—Mitchell J. Halista; Trevor B. Joike

[57] ABSTRACT

A float stabilized constant current source uses a floated cylinder with a rotational signal output generator and two torque generators for applying a linear torque and an opposing current squared torque to the floated cylinder, respectively. The current squared torque is balanced against the linear torque by a servo system applying a current to the torque generators in series to create a point of zero net torque on the floated cylinder. The current is obtained from the signal generator representative of a cylinder rotation and is used as a stabilized constant output current, i.e., a precision constant current reference driving an electrical load.

6 Claims, 4 Drawing Figures

FLOAT STABILIZED CONSTANT CURRENT SOURCE

BACKGROUND OF THE INVENTION

1. Field of the Invention

The present invention relates to constant current sources. More specifically, the present invention is directed to a stabilized constant current source using floated inertial instrument technology.

2. Description of the Prior Art

Presently precise constant current sources are based on a precision voltage reference. The zener diode, a semiconductor device, is the most commonly used precision voltage reference. The zener diode may be connected in a circuit which uses a precision resistor in series with a load to measure the current through the load. The voltage drop across the precision resistor is fed back to the negative input of an operational amplifier connected to function as an integrator. The zener diode drives the positive input of the operational amplifier. The constant current through the load is then controlled by the zener diode voltage. Such a circuit is used to provide most accuracy requirements for constant current sources since the circuit exhibits very good voltage stability and turn-on repeatability. However, in certain applications, such as ballistic missiles, there are stringent nuclear hardness requirements. Under exposure to nuclear radiation, the accuracy of the zener diode decays significantly.

Floated inertial instruments are well-known in the art as described in the publication, "Gyroscopic Theory, Design and Instrumentation" by Wrigley, Hollister and Denhard, published by the M.I.T. Press in 1969. The inertial instruments use a floated cylinder with electromagnetic suspensions that allow freedom of rotation of the cylinder. A signal generator is used with the floated cylinder in the form of a rotational transducer for detecting the motion of the cylinder and producing a representative output signal. In order to produce a stabilized constant current reference source, it would be desirable to combine the flotation technology used in modern inertial navigational instruments with a current control servo system to provide equivalent accuracy of a zener system and the capability of a rapid recovery from a nuclear event.

SUMMARY OF THE INVENTION

An object of the present invention is to provide an improved current source. Another object of the present invention is to provide an improved current source which is stabilized by using a floated cylinder.

In accomplishing this and other objects, there has been provided, in accordance with the present invention a current source including a current output circuit, a floated cylinder, a rotational signal generator arranged to produce an output signal representative of the rotation of the floated cylinder, a first torque generator arranged to affect the rotation of the floated cylinder by a torque directly proportional to an electrical current, a second torque generator arranged to affect the rotation of the cylinder by a torque directly proportional to the square of an electrical current and in opposition to the torque from the first torque generator and a current control means for providing a feedback connection between the output of the rotational signal generator and a series connection of the linear torque generator, the current squared torque generator and the current output circuit.

BRIEF DESCRIPTION OF THE DRAWING

A better understanding of the present invention may be had when the following detailed description is read in connection with the accompanying drawings, in which.

DESCRIPTION OF THE PREFERRED EMBODIMENT

Figure 1:
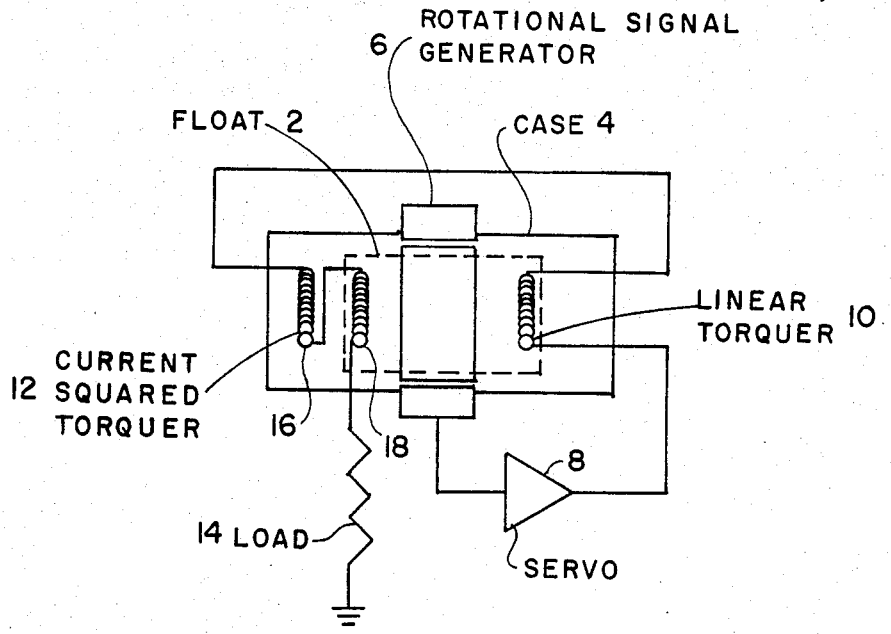
FIG. 1 is a schematic illustration of a stabilized constant current source embodying an example of the present invention.
Figure 2:
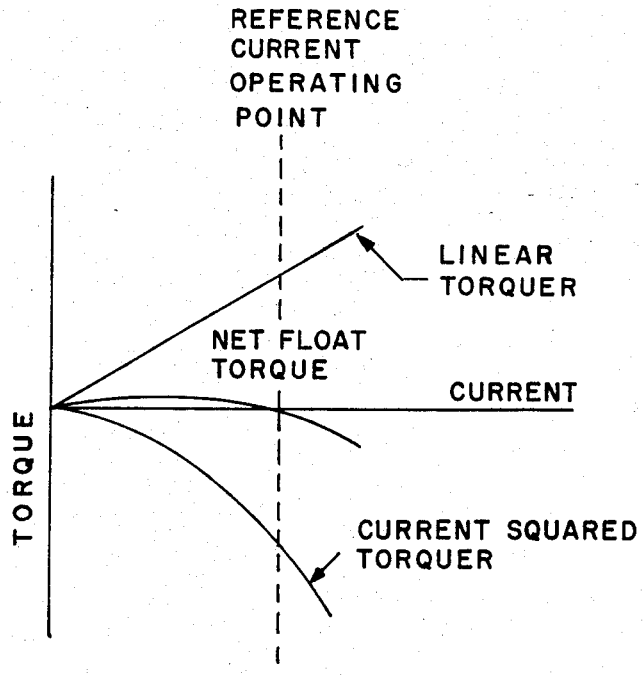
FIG. 2 is a diagram illustrating the operation of the constant current source shown in FIG. 1.

Referring to FIG. 1 in more detail, there is shown a schematic illustration of a constant current source embodying the present invention utilizing a float 2 located within a housing or case 4. A rotational signal generator 6 is arranged to produce an output signal representative of the rotation of the float 2. The output of the rotational signal generator 6 is applied through a servo amplifier 8 to a linear torque element or torquer 10 which is arranged to be in series with a current squared torque element or torquer 12. The current path from the current squared torquer 12 is arranged to be in series with an electrical load element 14 which may be a resistor. The other end of the resistor 14 is connected to a common ground connection as a current return path. The current squared torquer 12 includes a fixed coil 16 and a moving air core coil 18 connected in series to produce a torque which is a function of the square of the applied current. As shown in FIG. 2, by balancing the torque from a current squared torque element against the torque from a linear torque element a point of zero net torque is created which occurs at a specific reference current. By using this specific current level as a current source for the load 14 the apparatus of the present invention servos to zero net torque to produce a stabilized constant current source.

The float 2 is maintained in position by a negative torque feedback. For example, if the float 2 moves clockwise the restoring torque will be counterclockwise. Negative feedback is a basic requirement for a stable feedback system. System stability is also enhanced because of the large damping coefficient created by a viscous flotation fluid. The float 2 does not reside at a null of the signal generator 6 but resides at an offset angle that provides the signal for the reference current. If the load 14 changes, the reference current will change causing an unbalanced torque on the float 2 due to the difference in characteristics between the two torquers. The float 2 will then rotate to a new position causing the torques to balance. At the new position of the float 2 the output from the signal generator 6 will be such that the reference current will be restored since the torquers 10,12 have equal and opposite torques only at the reference current. Hence, the float 2 will move to a new angular position as required to maintain a constant current output. Errors are caused by torque disturbances on the float. A torque disturbance on the float 2 will cause the torque balance between the linear and squared function torquers to occur at a different reference current. The torque disturbances that are typical in a floated instrument, such as used in inertial guidance, develop from torque instabilities and will cause errors of less than a few parts per million.

Figure 3:
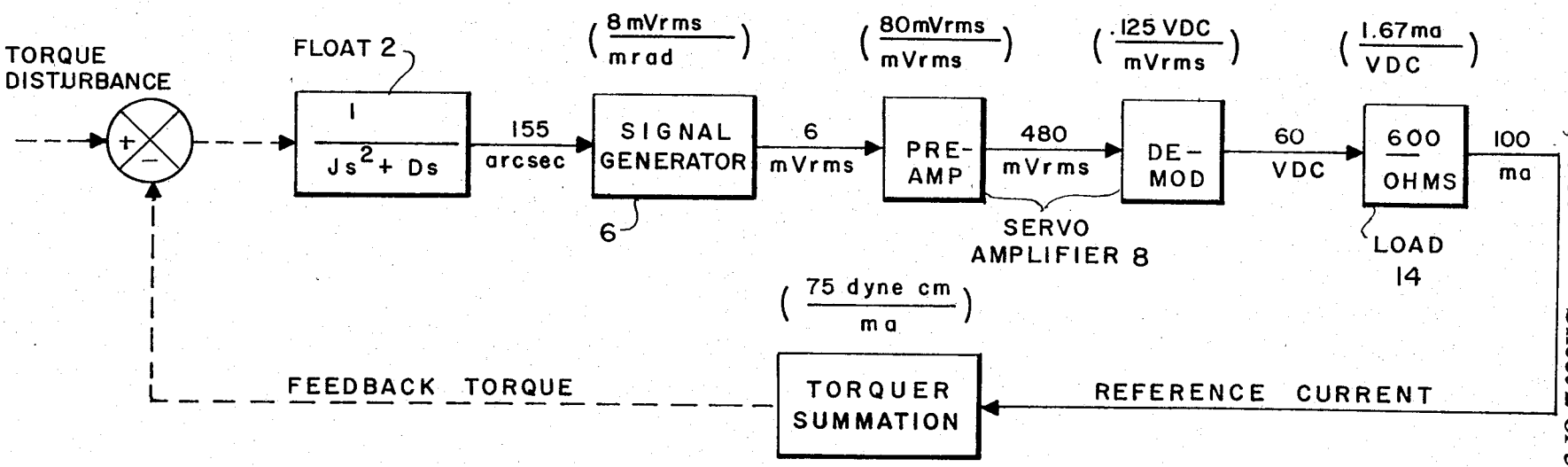
FIG. 3 is a detailed system diagram illustrating the operation of the constant current source shown in FIG. 1.

In FIG. 3, there is shown a detailed system diagram illustrating the parameter selections used in a specific example of the current source of the present invention. A more detailed discussion of this diagram is provided hereinafter.

Figure 4:
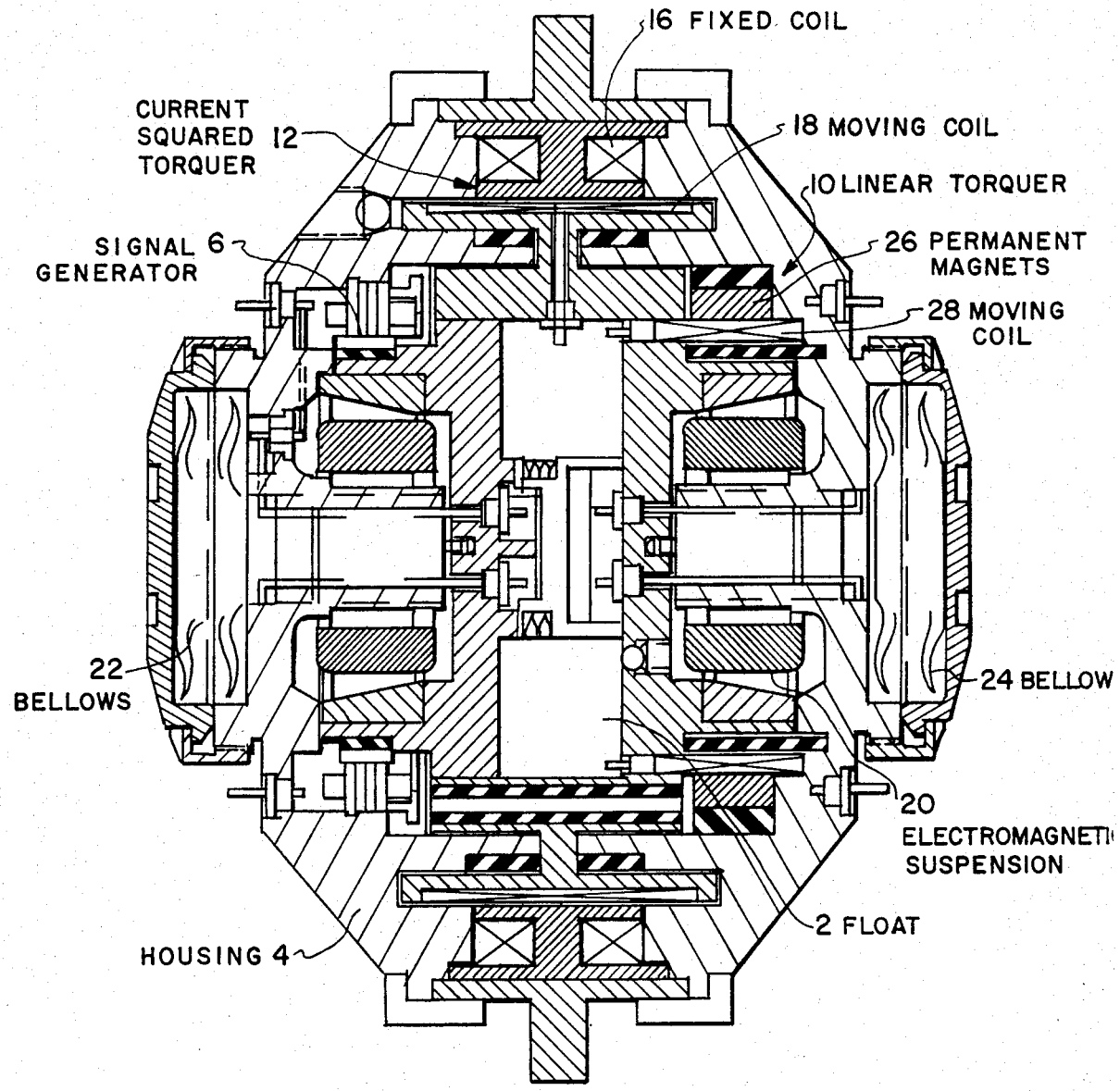
FIG. 4 is a cross-sectional illustration of an example of a stabilized constant current source embodying the present invention.

In FIG. 4, there is shown on a cross-sectional illustration of a float stabilized current source embodying an example of the present invention. A conventional electromagnetic suspension 20 is used to suspend and center the float 2 by using opposing axial and radial forces. The housing or case 4 includes a plurality of separate sections which are assembled to form a fluid-tight structure containing a viscous flotation fluid. A pair of bellows 22,24 are provided on the housing and exposed to the pressure of the flotation fluid to provide for temperature expansion of the fluid. The balanced cylinder or float 2 is acted upon by two torque generating units or torquers 10,12. In one torque generating unit the torque is linearly proportional to current, i.e., torquer 10, while in the other torque unit the torque is proportional to current squared, i.e., torquer 12. The linear torquer 10 uses fixed permanent magnets 26 to create a constant magnetic field in a first air gap. A moving air core coil 28 is located in the air gap. The current squared torquer 12 has fixed field coils 16 with a magnetic material core providing magnetic pole faces to create a magnetic field in a second air gap. A moving air core coil 18 is located in the second air gap. The coils 16,18 are connected in series as shown in FIG. 1 to provide a torque which is a function of the square of the coil current. At the reference current the torque from the current squared torquer 12 and the linear torquer 10 will be equal and in opposite direction, i.e., there will be no net torque on the float 2. Whenever the reference current changes, e.g., due to input power variations, load variation, etc., there will be a net torque, and the float 2 will start to rotate. The signal generator 6 detects this movement and produces an output signal which is used by the servo loop to readjust the current to the reference current until there is no net torque. The current through the torquers 10,12 is used as the constant current output for the load 14.

As shown in FIG. 3, the reference current is 100 ma and the summation of the torquers 10,12 is 75 dyne cm per milliampere. The inertia of the float J is 8 gm $cm^2$ and the float damping D is 75,000 dyne cm per ma. The float 2 resides at a signal generator 6 position offset from the null by 155 arcseconds when supplying 100 ma of current. When signal generator 6 is producing 6 mVrms, the output of the preamplifier is 480 mVrms and the output of the demodulator is 60 VDC. With a load 14 of 600 ohms the 60 VCD will drive a current of 100 milliamps. A float stabilized constant current source implemented as shown has disturbance torques of less than 0.02 dyne cm causing inaccuracies less than a few parts per million.

Accordingly, it may be seen that there has been provided, in accordance with the present invention, an improved constant current source utilizing a float stabilized constant current source.

The embodiments of the present invention in which an exclusive property or privilege is claimed are defined as follows:

1. A current source comprising a current output circuit, a floated cylinder means including a floated cylinder, a first torquer means arranged to produce a torque on said cylinder directly proportional to an electrical current, a second torquer means arranged to produce a torque on said cylinder directly proportional to the square of an electrical current and opposite to the torque produced by said first torquer means, signal generator means for producing an output current representative of a rotation of said cylinder and servo means for supplying a feedback connection for the output current from said generator means to a series connection of said first and second torquer means and said output current circuit.

2. A current source as set forth in claim 1 wherein said first torquer means, a first permanent magnet means for establishing a fixed magnetic field across a first stationary air gap and a moving air core coil means located in said gap.

3. A current source as set forth in claim 2 wherein said second torquer means includes a magnetic coil means having a field coil, a magnetic core with magnetic pole faces defining a second stationary air gap and a moving air coil connected in series with said field coil and located in said second air gap.

4. A current source as set forth in claim 3 wherein said signal generator means includes transducer means spaced from said cylinder for detecting a rotation of said cylinder.

5. A current source as set forth in claim 4 wherein said cylinder means includes a housing for said cylinder and a viscous flotation fluid within said housing for floating said cylinder.

6. A current source as set forth in claim 5 wherein said cylinder means includes electromagnetic suspension means for said cylinder.

* * * * *